United States Patent [19]

Diamond

[11] 4,257,560

[45] Mar. 24, 1981

[54] PLURAL SPRAY PATTERN AEROSOL SPRAY HEAD

[76] Inventor: George B. Diamond, Anthony & Woodglen Rds., R.D., Glen Gardner, N.J. 08826

[21] Appl. No.: 960,455

[22] Filed: Nov. 13, 1978

[51] Int. Cl.[3] ..... B05B 1/16

[52] U.S. Cl. ..... 239/337; 222/331; 222/402.17; 222/545; 239/447; 239/579

[58] Field of Search ..... 239/337, 443–448, 239/579; 222/331, 402.12, 402.17, 486, 511, 545, 385

[56] References Cited

U.S. PATENT DOCUMENTS

| | | | |
|---|---|---|---|
| 2,538,211 | 1/1951 | Prout | 239/446 |
| 3,138,331 | 6/1964 | Kutik | 239/579 |
| 3,669,321 | 6/1972 | Susuki et al. | 222/545 |
| 3,680,738 | 8/1972 | Vos et al. | 222/402.12 |
| 4,077,548 | 3/1978 | Beard | 222/385 |

FOREIGN PATENT DOCUMENTS

| | | | |
|---|---|---|---|
| 1498565 | 10/1967 | France | 239/446 |
| 1100861 | 1/1968 | United Kingdom | 239/333 |
| 1162684 | 8/1969 | United Kingdom | 239/446 |
| 1313881 | 4/1973 | United Kingdom | 239/337 |

*Primary Examiner*—Robert B. Reeves
*Assistant Examiner*—Michael J. Forman
*Attorney, Agent, or Firm*—Ostrolenk, Faber, Gerb & Soffen

[57] ABSTRACT

A spray head for an aerosol container, or the like, for producing a plurality of spray patterns: The spray head includes a central spool with an inlet on its bottom side in communication with the valve stem leading out of the aerosol spray container and with an outlet on the side of the spool. A shell or sleeve surrounds the spool and is longitudinally movable with respect to the spool. The sleeve has two longitudinally spaced apart outlets. Longitudinal shifting of the sleeve with respect to the spool aligns one or the other outlet from the sleeve with the spool outlet. A spring normally returns the sleeve so that a first outlet thereof is aligned with the spool outlet. The entire spray head sits on the valve stem. The valve stem with the associated valve element in the container is spring biased to normally close the valve. The spring force on the valve is less than the spring force in the spray head. Initial pressure applied to the spray head opens the valve, but does not shift the sleeve with respect to the spool. Further pressure on the spray head thereafter shifts the sleeve with respect to the spool. The different shifted positions of the sleeve with respect to the spool determine which outlet from the sleeve emits sprayed material. Each sleeve outlet has a nozzle for defining a respective spray pattern. Sealing elements on the spool assure exit flow only through the selected outlet from the sleeve and may also seal the other outlet.

28 Claims, 10 Drawing Figures

PLURAL SPRAY PATTERN AEROSOL SPRAY HEAD

The invention relates to the spray head for an aerosol spray container and to a container employing such a spray head, and particularly relates to such a spray head which is positioned over the valve of the container and which is adapted to deliver different spray patterns depending upon how the spray head is operated.

BACKGROUND OF THE INVENTION

Pressurized aerosol spray containers contain fluent liquid or solid particulate material which are forced through the outlet of the spray container by an appropriate propellant stored in the container, such as Freon gas or even air under pressure. The container has an outlet and the outlet is normally sealed closed by a valve. An actuator is associated with the valve such that operation of the actuator by the user of the aerosol spray container opens the valve and releases the pressurized material.

The valve includes a movable valve element. The valve opening into the container is associated with a valve seat. The valve element is biased into engagement with the valve seat in the container for normally keeping the valve sealed and the valve is opened upon appropriate manipulation of the actuator. The valve actuator typically includes a valve stem connected to the valve element and movable therewith. Movement of the valve stem raises the valve element off the valve seat and opens the valve.

The typical valve stem is provided with a passage extending through it which communicates into the container for receiving pressurized fluent material when the valve stem is moved to open the valve. The valve stem passage has an outlet that is normally outside the container. The pressurized material leaves the container through the valve stem outlet.

The actuator further comprises a spray head with an inlet that forms a continuous passage with the outlet from the valve stem and with an outlet that communicates with the spray head inlet and that sprays the fluent material. The outlet from the spray head is a nozzle, which is appropriately configured to provide the desired spray pattern for the fluent material. Such a spray pattern may be a narrow stream which is intended to impinge only upon a small area surface, or a wider spray pattern which is intended to impinge upon a greater width or height target or any other spray pattern which is desired for a particular application.

Conventional spray heads have only a single outlet nozzle and are, therefore, usually capable of only producing a single spray pattern. With respect to certain aerosol sprays, under varying circumstances that may arise, it may be desirable to enable the aerosol spray container to dispense materials in spray patterns which differ either in the area covered by the spray, or in the rate of discharge of the sprayed material or in other respects. One instance where selectable spray patterns might be needed is in connection with anti-personnel disabling sprays. In certain circumstances, it is desirable to be able to rapidly select between two different spray patterns, without relatively complicated manual manipulations being required for the selection. When a single person or object should be sprayed with an anti-personnel spray, then a narrower spray pattern would be desired. However, where a larger group of persons or a wider object is to be sprayed, then a second wider spray pattern would be desired. For example, in a police and/or military situation, a single offender may be approaching a police officer or soldier and he would wish to direct a narrow field of spray solely at the single person for disabling him. On the other hand, if a large group of perpetrators or adversaries is approaching the police officer or soldier, the adversaries may be widely separated and a wider spray pattern would be desired. In another situation, the police officer or soldier may have to spray rapidly, and over a wide area because of imminent danger from a number of separate sources or because he does not have time to aim a spray nozzle accurately. In the latter two situations, the police officer or soldier would like to be able, without complex manipulations, to simply dispense the wide area spray pattern.

Various techniques have been developed toward enabling various spray patterns to be emitted from an aerosol spray container. In one line of prior art, the spray head for the aerosol spray container, or the like spray container, is provided with a plurality of different outlets, each adapted to deliver a particular spray pattern. The spray head must initially be adjusted between different spray head orientations in order to effect communication between the desired outlet and the outlet valve of the container. Only after such manipulation has been completed, may the spray head be actuated to open the valve and spray the fluent material through the selected nozzle. This prior art has the drawback that two steps are required, first, manipulation to select the desired nozzle and second, operation of the spray head to spray the fluent material. In embodiments of this first line of prior art, the spray head is rotated so as to cause communication between a selected spray head outlet and the outlets from the container valve. Examples of this are U.S. Pat. Nos. 3,762,650 and 3,083,872. Also of interest in showing various manipulations that are performed on the spray head before the spray head may be operated to open the valve is U.S. Pat. No. 3,258,208. In the latter reference, instead of rotating the spray head, the spray head is removed and inverted, with each orientation of the spray head positioning a different nozzle for communication with the outlet from the container valve.

In a second line of prior art, there is but a single outlet nozzle served by a plurality of different inlets into the valve for varying the rate of flow into the valve and, therefore, into the spray head which, of necessity, also varies the rate of flow out of the spray head. Examples of this are U.S. Pat. Nos. 3,231,153 and 3,292,827. In both of these patents, the inlets to the valve inside the container are manipulated by operation of the spray head so as to cause communication between one or both of the inlets into the valve and, therefore, the spray head outlet. A structure requiring a plurality of openings at the valve inside the container requires fabrication of a special, hard to make valve.

In none of the prior art of which the inventor hereof has knowledge does the spray head itself serve to select one of a plurality of spray patterns and to make this selection simultaneously with and as a result of the extent of finger pressure applied to the spray head itself so that different finger pressure by itself selects a different outlet nozzle adapted thereby to produce a respective flow pattern from the spray head.

SUMMARY OF THE INVENTION

It is the primary object of the present invention to provide means for causing an aerosol spray container, or the like container to dispense various respective spray patterns, wherein the selection of spray patterns is solely dependent upon the same finger pressure that simultaneously also causes the spray to be emitted in the selected spray pattern.

It is another object of the invention to permit a selected spray pattern among a plurality thereof to be emitted from a spray head without manipulation of the spray head being required prior to the operation of the spray head for emitting fluent material with a desired spray pattern.

It is a further object of the invention to realize the foregoing objects using a conventional aerosol spray container with a conventional single port outlet valve from the spray container.

It is yet another object of the invention to realize the foregoing objects through the provision of a spray head which self contains the means required for accomplishing the foregoing objects.

According to the present invention, the spray head comprises a central body or spool, which is seated on the valve stem of the aerosol spray container. The valve, in turn, is spring biased normally to the closed position and by manipulation of the spray head, the valve stem is operated, which opens the valve permitting emission of fluent material through the valve stem into the spool of the spray head.

The spool has an inlet communicating with the outlet from the valve stem. The spool has a passage through it which joins the spool inlet to a spool outlet which is preferably located on a side surface of the spool.

The spray head further comprises an external portion, in the form of an annular shell or sleeve, which fluent material sealingly engages and also surrounds the central spool. The shell is axially shiftable with respect to the spool, preferably along the same direction that the valve stem must be shifted with respect to the container for opening the valve to permit emission of the fluent material. The sleeve of the spray head is provided with a plurality of outlet ports. The adjustment of the relative axial or longitudinal position of the spool of the spray head with respect to the surrounding sleeve thereof determines which of the outlet ports of the sleeve of the spray head communicates with the passage outlet from the spool of the spray head. Each outlet port from the sleeve of the spray head is configured so as to produce a preferably different respective spray pattern.

Biasing means provided in the spray head normally hold the sleeve around the spool at a first longitudinal position that causes communication between the passage outlet from the spool of the spray head and a first one of the outlet ports through the sleeve of the spray head. The pathway from the valve through the spool to the sleeve is normally closed because the valve of the pressurized container is sealed.

Upon initial manual pressure being applied to the spray head, the entire spray head is shifted, which shifts the valve stem to open the valve and permit outflow of fluent material from inside the container, through the spool of the spray head and out the first outlet port of the spray head sleeve. The biasing means provided in the spray head exert a stronger biasing force than the force required to open the valve, whereby the spray head sleeve remains in its first longitudinal position with respect to the spool as the valve opens.

Upon additional manual pressure being applied to the spray head, preferably in the same direction that operates the valve to open, the biasing means between the spool of the valve spray head and the sleeve of the spray head is overcome, and the sleeve shifts longitudinally with respect to the spool so as to break the communication between the passage through the spool and the first outlet port of the sleeve and to establish communication between the passage through the spool and a second outlet port of the sleeve.

In accordance with a further feature of the invention, various embodiments of means for ensuring that the first and second outlet ports of the sleeve of the spray head are separated from each other are provided. Furthermore, the same sealing means operate to prevent leakage flow along the interface of the spray head sleeve and the spray head spool inside it. Finally, in one embodiment, the sealing means actually seal closed the sleeve outlet port through which fluent material is not then exiting.

One of the valuable purposes of the present invention is in police and/or military use where certain anti-personnel chemicals are contained in the pressurized container. When the spray head is depressed to a first extent, the first spray pattern sprays a narrower field and provides a more concentrated spray for one person. However, a policeman and/or soldier may face a large group or a widely dispersed group and may wish to direct the spray over a wider field. Then, by applying a greater force to the spray head, the first spray pattern halts and a second spray pattern is emitted. The second pattern provides a wider field of spray. Another way of viewing this is that the first spray pattern would be used in a more easily controlled situation while the second spray pattern might be used in a panic situation where time for precise aiming is not available.

DESCRIPTION OF THE PREFERRED EMBODIMENTS

Figure 7:
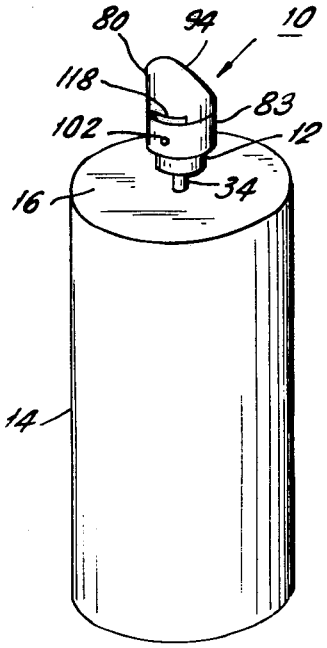
FIG. 7 is a perspective view of the exterior of an entire aerosol container provided with the spray head of FIGS. 1–6.

Referring to FIG. 7, a spray head 10 according to the first embodiment of the invention is shown atop the valve stem 12 of a conventional pressurized aerosol container 14 for containing pressurized fluent material, of either a liquid or particulate nature. The material in the container is pressurized by an appropriate propellant. The material in the container exits through the valve stem 12 and through the spray head 10.

Figures 1, 2, 3:
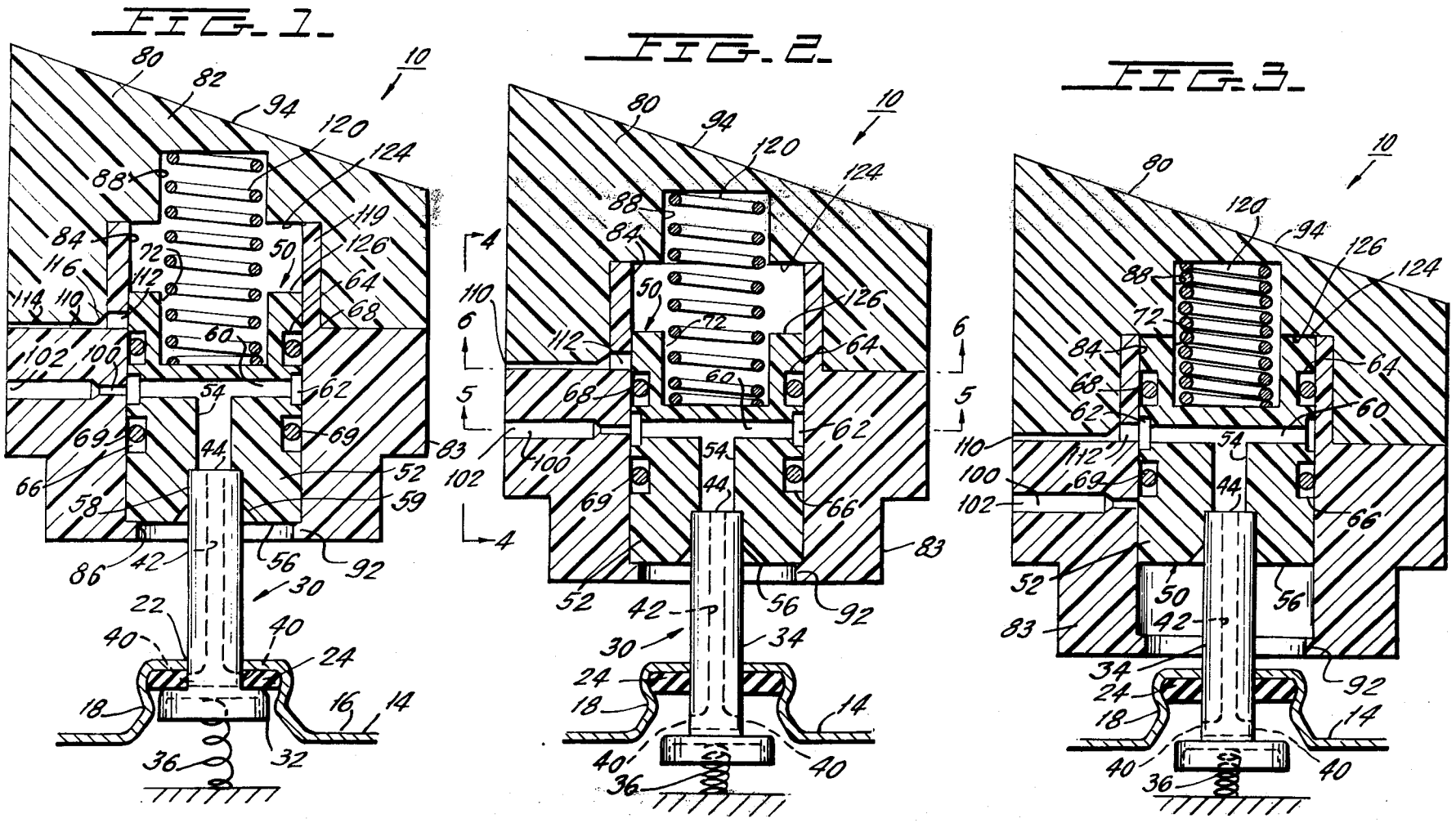
FIG. 1 is a cross-sectional, elevational view showing the novel spray head of the invention in conjunction with a typical valve on a pressurized container, wherein the valve and spray head are in their respective inoperative, rest positions.
FIG. 2 shows the same apparatus as FIG. 1, but showing the apparatus at a position operative to emit fluent material through a first outlet from the spray head.
FIG. 3 is a view of the same apparatus as FIG. 1, but showing the apparatus at a position operative to emit fluent material through a second outlet from the spray head.

Referring to FIGS. 1 and 7, the container 14 has an upper end surface 16 at the center of which is defined an upstanding valve chamber and outlet section 18. Centrally of the upstanding section 18, there is defined an opening 22 through the container top wall 16 through which the valve stem 12 projects. The top portion of the container outlet section 18 contains and supports a resilient, annular valve seat 24, which surrounds the container opening 22. The valve seat 24 resiliently yields under force applied thereto by the below described valve element 30, 32.

There is a valve element 30 comprised of the valve element base portion 32 and the upstanding valve stem 12. The valve stem 12 projects through the opening 22, and the valve element base portion 32 normally presses against the valve seat 24 to seal the same. Appropriate biasing means 36, well known in this art, urge the valve 30 to the sealed position illustrated in FIG. 1 wherein the valve element base portion 32 is urged against the valve seat 24. One known technique (not illustrated) for biasing the valve element 30, 32 to the up position shown in FIG. 1 is the provision of a resilient collar around the valve stem 12, which is continuously in contact with the top of the outlet section 18 of the container and continuously pushes down against the top of the container which, in turn, urges the valve element 30, 32 upwardly. There are other conventional biasing means.

The valve stem 12 has inlet ports 40 thereto at the lower end thereof at or slightly above the valve element base portion 32. With the valve element base portion 32 sealingly engaging the valve seat 24, the ports 40 are sealed closed against outflow of any fluent material in the container 14. On the other hand, with the valve stem 12 moved inwardly of the container, against the biasing force of biasing means 36, in the condition shown in FIG. 2, the ports 40 are now opened to the interior of the container for permitting outlet of fluent material from the container 14.

There is a conduit 42 that communicates with the inlet ports 40 to the valve stem 12 and that extends longitudinally up through the length of the valve stem 12 and that terminates in an outlet port 44 from the valve stem. Upon shifting of the valve element 30, 32 from the position shown in FIG. 1 to the position shown in FIG. 2, fluent material from within the container 14 exits through the outlet port 44.

The spray head 10 according to the first embodiment of the present invention is, most broadly expressed, comprised of the central spool 50, the adjacent body portion of the spray head, which is comprised of external shell or sleeve 80, and the biasing means 120 communicating between the sleeve and the spool for maintaining them in the first longitudinal position illustrated in FIGS. 1 and 2.

The spool 50 is comprised of a generally cylindrical body 52. An axial bore 54 extends partially through the body 52 from the bottom end 56 thereof to the below described transverse bore 60. The lower section 58 of the bore 54 is widened so as to tightly and securely fit over the upper end of the valve stem 12, which thereby supports the spray head 10 on the valve stem 12 and enables the mounting of the spray head without its tilting or falling off the valve stem. The lower end 59 of the widened lower section 58 is flared to ease insertion of the valve stem 34 into the section 58.

A transverse bore 60 extends across the cylindrical body 52 and communicates with the axial bore 54. The transverse bore 60 outlets at its opposite ends into the annular groove 62 which extends completely around the body 52. Any fluent material that exits from the valve stem 12 through its outlet 44 passes through the passage defined by the bores 54 and 60 and into the groove 62 for subsequent discharge through the sleeve 80 of the spray head. The groove 62 is annular in order that the relative rotational orientations of the spool 50 and the sleeve 80 do not have to be preset in order for the spray head to operate properly.

Both axially above and below the groove 62 in the body 52, there are additional annular grooves 64 and 66 for receiving respective O-ring seals 68 and 69, or the like seals. These O-rings 68 seal securely against the interior of the opening 84 through the sleeve 80, thereby preventing leakage along the interface between the sleeve 80 and the spool 50. As will become apparent below, the longitudinal distance between the annular grooves 64 and 66 is selected so that, in the two different operative orientations of the spray head, as shown in FIGS. 1 and 2, on the one hand, and in FIG. 3, on the other hand, one of the O-ring seals 68 is always interposed between the two below described outlet conduit means 100, 110 from the spray head 10, thereby assuring that fluent material will flow only out one outlet at a time. In the embodiment of FIGS. 1–3, one of the seals 68, 69 is between the outlet ports 100, 110 and the other seal is at the side of the outlet port then dispensing spray which is away from the other outlet port. For example, with the outlet port 100 in service, the seal 68 is between the ports 100 and 110 and the seal 69 is on the other side of the same port 100.

At the top end of the spool body 52 is the spring receiving opening 72 for receiving the below described spray head spring 120.

A second major element of the spray head 10 is the sleeve 80 thereof which is a single unit that always stays together and moves together. For convenience of manufacture of an element having all of the below described characteristics of the spray head sleeve 80, it is simpler to fabricate the sleeve 80 in two principal sections, the upper section 82 and the lower section 83. But, the sections 82, 83 are always together and will hereafter be described as though they are a single integral element.

The sleeve 80 has a central bore 84 extending upwardly therethrough from the bottom end 86 thereof. The bore 84 terminates in a narrowed upper section 88 for receiving the spring 120. The bore 84 is circular in cross-section and is dimensioned to slidlingly, but sealingly receive and define an interface with the periphery of the body 52 and the O-ring seals 68, and to permit the body 52 to axially shift along the bore 84. The bottom end of the bore 84 is narrowed by the flange 92 which retains the body 52 within the bore 84 against the bias of the spring 120. The body 52 is able to move upwardly through the bore 84 toward the bore section 88 compressing the spring 120.

The top surface 94 of the spray head 10 is tilted to ease finger pressure and to provide a readily discernible indication of the orientation at which the operator should hold the spray head when he presses down on it.

Figure 5:
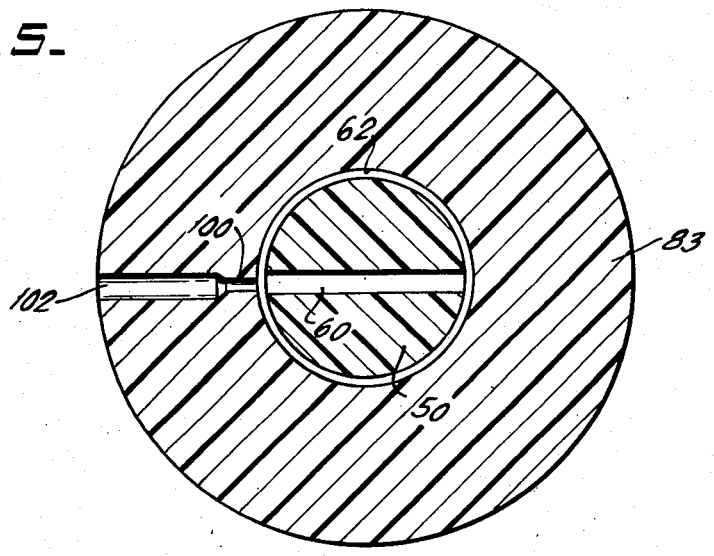
FIG. 5 is a transverse cross-sectional view of the spray head of FIG. 2 showing the first outlet port from the spray head and viewed along the lines 5—5 in FIG. 2.

The sleeve 82 is provided with a first spray outlet conduit means 100 which terminates in the outlet nozzle 102 on the periphery of the sleeve 80. As shown in both of FIGS. 1 and 5, the nozzle 102 is a small diameter opening, which produces a narrow diameter or narrow cross-section spray pattern, which is concentrated and sprays a relatively limited area.

As is apparent from FIGS. 1 and 2, both before any spray is emitted and during spraying of a first spray pattern, as described further below, the annular sealing rings 68, 69 isolate the spool passage 60 and the sleeve outlet conduit means 100, 102 from leakage to the below described second outlet conduit means 110.

Figure 6:
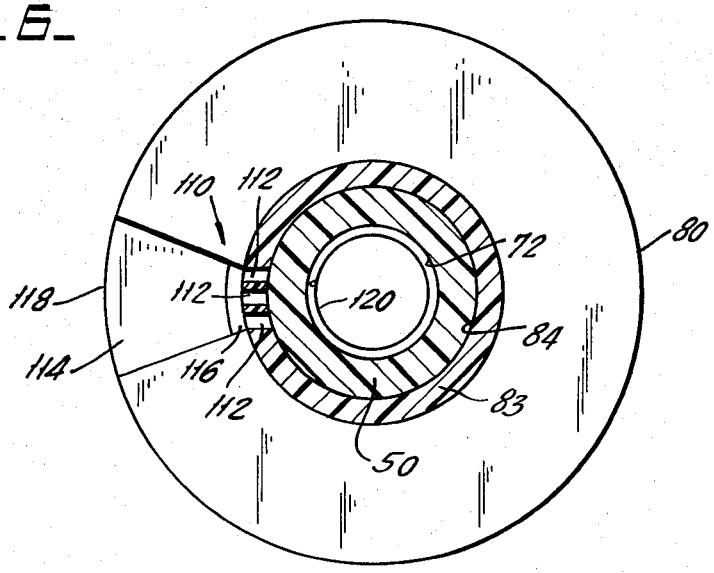
FIG. 6 is a transverse cross-sectional view of the spray head of FIG. 2 showing the second outlet port from the spray head and viewed along the lines 6—6 of FIG. 2.
Figure 4:
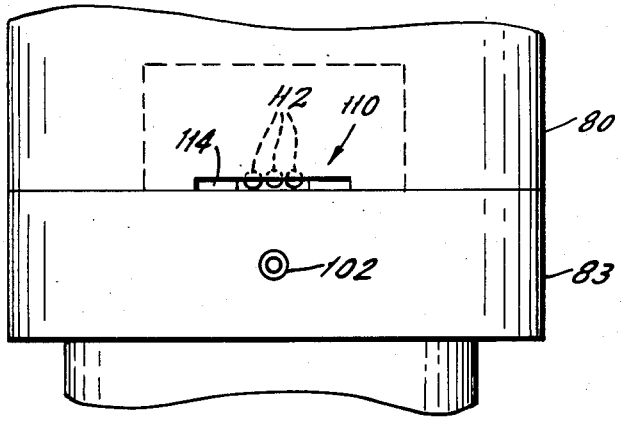
FIG. 4 is an elevational view of the spray head from the side of the spray head through which the outlet ports emit fluent material, and viewed between and in the direction of the arrows 4—4 of FIG. 2.

The sleeve 82 includes a second spray outlet conduit means 110, which is operative only when the actuator sleeve 80 is fully depressed into the condition of FIG. 3. The outlet conduit means 110 communicates with the annular groove 62 in the spool when the spray head 10 is in the position of FIG. 3. The conduit means 110 comprises a plurality of small bore openings 112, each of which communicates between the interior of the bore 84 and the narrow height passageway 114. The passageway 114 is shorter in height than the openings 112, and the shorter height develops over the narrowing section 116 of the outlet conduit means 110. As is apparent from FIGS. 4 and 6, the outlet passageway 114 gradually fans outwardly sideways, ultimately leading to a wide spray angle nozzle 118 that is short in height. As a result, material sprayed out of the nozzle 118 forms a wide angle, short height spray pattern suitable, for example, for simultaneously spraying a group of persons with an anti-personnel chemical. The nozzle 102, on the other hand, produces a spray that is more suitable for spraying a single person with the same chemical.

As shown in FIG. 3, when the spray head 110 has been shifted so that the outlet conduit means 110 is operative to discharge fluent material, the annular seals 68, 69 have been shifted to bracket the outlet conduit means 110, thereby preventing leakage from the passage 60, 62 to the outlet conduit means 100 and blocking leakage along the interface between the spool 50 and the sleeve 80.

For simplicity of construction of the spray head 10, it is beneficial, as noted above, for the sleeve 80 to be comprised of the two integrated sections 82, 83. In the sleeve 80, the top surface of the lower section 83 of the sleeve is flat, whereas the undersurface of the upper sleeve section 82 is machined out to define the outlet conduit means sections 114, 116. The upstanding annular flange 119 of the lower sleeve section 83 is bored to define the openings 112.

A compression spring 120 is interposed between the sleeve 80 and the internal spool body 52, and the spring is received in the narrowed diameter bore section 88 of the upper sleeve section 82 and the narrowed diameter bore section 72 of the body 52. Normally, the spring 120 pushes the sleeve 80 upwardly off the body 52 to the position shown in FIGS. 1 and 2. The spring 120 is stronger than the biasing means 36, whereby, as shown in a comparison of FIGS. 1 and 2, initial pressure applied to the spray head 10 from above first operates the biasing means 36 to lift the valve element 32 off the valve seat 24, thereby first opening the outlet conduit means 100, while the initial pressure only minimally deflects the spring 120. Only further greater pressure applied to the spray head 10 finally compresses the spring 120 so as to shift the sleeve 80 down with respect to the spool 50 to the condition of FIG. 3, thereby opening the second outlet conduit means 110.

Operation of the first embodiment of the spray head shown in FIGS. 1–7 is now described. Starting in the inoperative condition of FIG. 1, the valve element 32 is seated on the valve seat 24. This precludes exit of any of the fluent material from the container 14. Also, spring 120 assures that the sleeve 80 is upraised above the body 52 such that the flanges 92 rest against the underside 56 of the body 52. In this condition, the body passage 60 communicates with the outlet conduit means 100, but because the valve 32, 24 is sealed closed, there is no outlet flow from the container 14.

When initial manual pressure is applied by an operator to the top 94 of the spray head 10 and thus to the sleeve 80, the spring 120 maintains the sleeve 80 and the body 52 in their orientations of FIGS. 1 and 2. However, the initial pressure overcomes the biasing force of the biasing means 36 of the valve, thereby lifting the valve element 32 off the valve seat 24. This opens the outlet conduit 40, 42 through the valve stem 34 and permits the fluent material to exit from the container 14 through the valve stem 34, the passage 54, 60 and the outlet conduit means 100. As noted above, the annular seals 68, 69 bracket the passage 60 and the outlet conduit means 100, preventing leakage flow along the body 52. The flow out the outlet conduit means 100 is a limited cross-section spray pattern, as might be used by a police officer to spray a single person, or which might be used in like applications.

When a further downward force is applied to the spray head 10, greater than the force applied to the spray head in the condition of FIG. 2, because the biasing means 36 has already been overcome, the greater force now overcomes the biasing means 120 and compresses that spring, thereby allowing the sleeve 80 to move downwardly over the body 52, while the body 52 essentially remains in the same position it had with respect to the container 14 in the spray head condition of FIG. 2. The sleeve 80 moves down over the body 52 until the underside 124 of the sleeve 80 engages the upper side 126 of the body 52, which precludes further descent of the sleeve 80. Now the spool body passage 60 is aligned with the second outlet conduit means 110 and the annular sealing rings 68, 69 bracket the outlet conduit means 110. This produces the wider angle spray pattern.

Upon release of the downward pressure upon the spray head 10, the biasing means 120 and 36 return the spray head to its condition of FIG. 1 for subsequent operation.

In summary, with the above described invention, simply dependent upon the force applied to the spray head itself, one of a plurality of outlet conduit means from the spray head is connected with the source of fluent material and the respective spray pattern produced by that outlet conduit means is the only spray pattern that would be emitted from the spray head. No prior adjustment or manipulation of the spray head is required to select a particular desired spray pattern.

Figure 8:
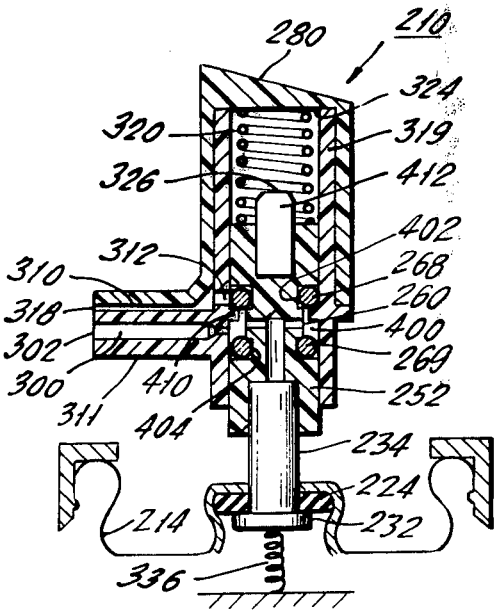
FIG. 8 is a cross-sectional, side elevational view, of the same type as FIG. 1, of a second embodiment of spray head, with a valve, according to the invention.
Figure 9:
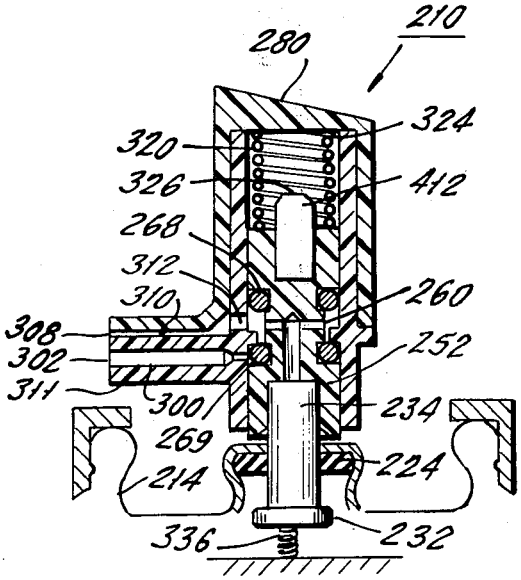
FIG. 9 is a view of the same apparatus as shown in FIG. 8 in the position thereof corresponding to the position shown in FIG. 3 for the first embodiment.

The second embodiment shown in FIGS. 8 and 9 is conceptually the same as the first embodiment and differs substantively only in the manner in which the outlet conduits from the spray head are sealed. Elements in the embodiment of FIGS. 8 and 9 which are structurally and functionally either identical to or substantially the same as the elements in the first embodiment will be correspondingly numbered with reference numerals raised by 200. The corresponding elements will not again be described. Only the features that distinguish the second embodiment from the first embodiment will be described in detail.

The sleeve 280, like the sleeve 80, has the first outlet conduit means 300 and the second outlet conduit means 310. In the second embodiment, the outlet conduit means 300, 310 are in a nozzle unit 311 of the sleeve 280. But, this is a matter of improved appearance of the sleeve, without substantively changing the significant constructional features of the sleeve.

In the first embodiment, the sealing rings 68, 69 bracket the respective outlet conduit means 100, 110 that is dispensing the fluent material. In the second embodiment, on the other hand, the spool body 252 is provided with a single annular chamber 400 having an upper annular groove portion 402 for receiving the upper annular O-ring seal 268 and a lower annular groove portion 404 for receiving the lower annular O-ring seal 269. The chamber 400 is of sufficient height along the body 252 so that, as shown in a comparison of FIGS. 8 and 9, the chamber 400 may communicate with only one of the outlet conduit means 300 for dispensing through the nozzle 302 or with the outlet conduit means 310 for dispensing through the nozzle 318. The interior of the sleeve 280 supports an annular flange 410 that projects inwardly sufficiently to be abutted by the sealing rings 268 or 269, depending upon whether the sleeve 280 is down or up (its positions of FIGS. 8 and 9, respectively).

The seals 268 and 269 are so placed that when the spray head is in its inactive condition shown in FIG. 8 (corresponding to the condition of FIG. 1 for the first embodiment) and also when the spray head has been moved to the condition following initial application of pressure to the spray head (not shown for the second embodiment but corresponding to the condition of FIG. 2 for the first embodiment), wherein the sleeve 280 is up with respect to the spool 250, then the pathway from the valve stem 234 is through the passage 260 to the chamber 400 and out the first outlet conduit means 300. In this case, the upper annular sealing ring 268 seals the second outlet conduit means 310 by actually seating in the outlet conduit means openings 312 and blocking them.

On the other hand, when the sleeve 280 is pressed fully downwardly, to the position of FIG. 9 (corresponding to the position of FIG. 3 for the first embodiment), the flange 410 is adjacent to the lower sealing ring 269 and the chamber 400 then communicates with the outlet conduit means 310. The annular seal 269 seats in and blocks the outlet conduit means 300, thereby assuring that flow from the valve stem 234 is only out the second outlet conduit means 310.

As a further modification of the first embodiment, instead of the spring 320 seating in a bore formed in the top of the body 252, a post 412 projects up from the top of the body 252 and the spring 320 is simply supported about the post. The extent to which the sleeve 280 may be depressed longitudinally over the body 252 is determined by the height of the post 412 because when the top surface 326 of the post 412 engages the undersurface 324 of the sleeve 280, this establishes the point of maximum depression of the sleeve 280.

As in the first embodiment, the different outlet conduit means 300, 310 produce different spray patterns.

Figure 10:
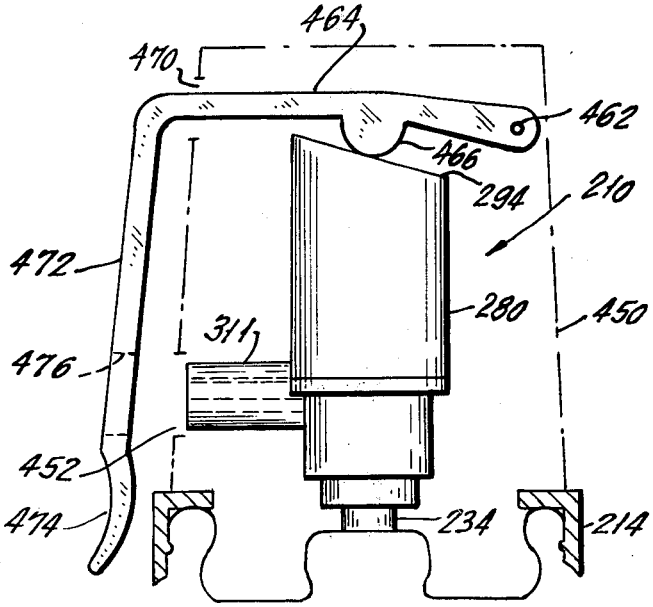
FIG. 10 is a partially cross-sectional, side elevational view of the apparatus shown in FIG. 8, but showing a third embodiment of the invention.

The third embodiment of FIG. 10 corresponds to the second embodiment of FIGS. 8 and 9, except that there is an operating apparatus associated with the container for operating the spray head. The spray head of the third embodiment has the same reference numerals applied thereto as the spray head of the second embodiment, and additional elements only are now described.

The container 214 has a permanently installed cap 450 disposed atop it within which the spray head 210 of this embodiment is enclosed. There is a first opening 452 on the side of the cap, through which the spray from the nozzle unit 311 may exit.

A pivoting handle means 460 is pivotally secured at pivot 462 inside the cap 450 and it includes the arm 464 which extends from the pivot 462 over and past the sleeve 280. A pressure lobe 466 beneath the arm 464 engages the top surface 294 of the sleeve 280. The arm 464 extends across the cap 450 and exits through an opening 470 in the cap 450. The opening 470 is large enough to permit the pivotal motion of the arm 460. The arm 460 includes an operator arm 472, which extends down along the cap 450 to the finger trigger 474. An opening 476 through the arm 472 is large enough to permit the spray from the nozzle unit 311 to pass by the arm 472 without impinging upon it.

The trigger 474 is far enough down along the container 214 so that when a person holds the entire container 214 by wrapping his hand around it, he can easily place his finger on the trigger 474.

Although the present invention has been described in connection with a number of preferred embodiments thereof, many variations and modifications will now become apparent to those skilled in the art. It is preferred, therefore, that the present invention be limited not by the specific disclosure herein, but only by the appended claims.

What is claimed is:

1. A spray head for being mounted to the valve of an aerosol spray container, or the like container, said spray head comprising:

a first portion of said spray head, including a spool comprised of a body having a passage therethrough; said body having a plurality of sides; said passage having an inlet communicating from one said side of said body; said body passage inlet being connectable with the valve of an aerosol spray container; said body passage having an outlet;

a second portion of said spray head positioned next to said spool; said second portion being movable longitudinally of and with respect to said spool while remaining next to said spool; said second portion having a first and a second outlet conduit means therethrough, both extending from the side of said second portion next to said spool to the outside of said second portion; said first and second outlet conduit means being spaced apart longitudinally along said second portion such that with said second portion at a first longitudinal position with respect to said spool body, said first outlet conduit means is positioned in communication with said body passage outlet, and with said second portion at a second longitudinal position with respect to said body, said second outlet is positioned in communication with said body passage outlet;

said first and second outlet conduit means and said body passage outlet being respectively so placed that, without prior operator selection of a position for said second portion with respect to said spool by motion of said second portion across the direction of longitudinal motion of said second portion, said second portion may be shifted longitudinally between said first and said second longitudinal positions.

2. The spray head of claim 1, further comprising spray head biasing means for returning said second portion in the direction away from said second longitudinal position and toward said first longitudinal position, such that motion of said second portion toward said second longitudinal position charges said spray head biasing means.

3. The spray head of either of claims 1 or 2, wherein said first and said second outlet conduit means of said second portion terminate in different respective nozzle arrangements, thereby to produce different respective spray patterns of emitted material.

4. In combination, an aerosol spray container and the spray head of claim 2, wherein said aerosol spray container includes:

a container;

a valve in said container for controlling exit of material from said container; said valve comprising:

a valve seat in said container; a valve element for seating against said valve seat; a valve stem in communication with said container such that upon shifting of said valve element off said valve seat, fluent material in said container is free to exit through said valve stem; said valve stem having a conduit therethrough with a conduit inlet placed such that when said valve element is off said valve seat, material can enter said valve stem conduit through said conduit inlet; said valve stem having a conduit outlet in communication with said body passage inlet.

5. The combination of claim 4, further comprising a groove defined around the periphery of said body and said body passage outlet communicating into said groove; said groove, in turn, selectively communicating with one of said outlet conduit means through said second portion, such selection being due to the longitudinal shifting of said second portion with respect to said body between said longitudinal positions.

6. The combination of claim 4, wherein said spray head is seated on said valve stem and moves along with said valve stem; said valve stem being connected with said valve element such that shifting of said valve stem, and with it said spray head, raises said valve element off said valve seat or returns said valve element to said valve seat.

7. The combination of claim 6, further comprising valve element biasing means for acting on said valve element for normally returning said valve element to said valve seat;

said spray head biasing means and said valve element biasing means exerting their respective biasing force along the same general direction; said spray head biasing means being adapted to exert a greater biasing force than said valve element biasing means such that upon application of initial force to said second portion, said valve element biasing means is charged while said spray head biasing means is substantially not charged, thereby raising said valve element off said valve seat and permitting exit of material from said container through said second portion first outlet conduit means, and upon application of greater force to said second portion against the direction of bias of said spray head biasing means, said spray head biasing means is also charged and said second portion shifts to said second longitudinal position, permitting exit of material from said container through said second portion second conduit means.

8. The combination of claim 7, further comprising a handle connected to said container and in engagement with said second portion and movable with respect to said container for moving said second portion with respect to said spool.

9. The spray head of claim 2, wherein said spool body and said second portion meet at an interface; sealing means between said body and said sleeve for sealing said interface between them against flow from said body passage along said interface.

10. The spray head of claim 9, wherein said sealing means comprises a first and a second sealing element supported on and movable with said body; said first and said second sealing elements being longitudinally spaced apart along said body; said sealing elements being placed and spaced such that with said second portion at said first longitudinal position, said first sealing element is positioned between said first and said second outlet conduit means and said second sealing element is on the side of said first outlet conduit means away from said second outlet conduit means, whereby said sealing elements bracket said first outlet conduit means; and with said second portion at said second longitudinal position, said first sealing element is on the side of said second outlet conduit means away from said first outlet conduit means and said second sealing element is positioned between said first and said second outlet conduit means, whereby said sealing elements bracket said second outlet conduit means.

11. The spray head of claim 9, wherein said sealing means comprises a first and a second sealing element supported on and movable with said body; said first and said second sealing elements being longitudinally spaced apart along said body; said sealing elements being placed and spaced such that with said second portion at said first longitudinal position, said first sealing element is positioned at said second outlet conduit means and blocks said second outlet conduit means, and said second sealing element is on the side of said first outlet conduit means that is away from said second outlet conduit means; and with said second portion at said second longitudinal position, said first sealing element is on the side of said second outlet conduit means away from said first outlet conduit means and said second sealing element is positioned at said first outlet conduit means and blocks said first outlet conduit means.

12. The spray head of any of claims 2, 10 or 11, further comprising a groove defined around the periphery of said body and said body passage outlet communicating into said groove; said groove, in turn, selectively communicating with one of said outlet conduit means through said second portion, such selection being due to the longitudinal shifting of said second portion with respect to said body between said longitudinal positions.

13. The spray head of claim 2, wherein said second portion comprises a sleeve surrounding said spool; said first and said second outlet conduit means extend across said sleeve.

14. The spray head of claim 13, wherein one said spool body side is a bottom side, and said body passage inlet is at said body bottom side; said body having another said side surrounded by said sleeve; said body passage outlet being at said body other side.

15. The spray head of claim 14, wherein another said spool body side is a top side and said top side is opposite to said body bottom side; said body top and bottom sides being different said sides of said body than said body other side; said sleeve being closed above said body top side; said spray head biasing means being connected between said sleeve and said body for biasing said sleeve with respect to said body.

16. In combination, an aerosol spray container and the spray head of claim 14, wherein said aerosol spray container includes:

a container;

a valve in said container for controlling exit of material from said container; said valve comprising:

a valve seat in said container; a valve element for seating against said valve seat; a valve stem in communication with said container such that upon shifting of said valve element off said valve seat, fluent material in said container is free to exit through said valve stem; said valve stem having a conduit therethrough with a conduit inlet placed such that when said valve element is off said valve seat, material can enter said valve stem conduit through said conduit inlet; said valve stem having a conduit outlet in communication with said body passage inlet.

17. The combination of claim 16, further comprising a groove defined around the periphery of said body and said body passage outlet communicating into said groove; said groove, in turn, communicating with said outlet conduit means through said sleeve, due to the longitudinal shifting of said sleeve with respect to said body.

18. The combination of claim 16, wherein said spray head is seated on said valve stem and moves along with said valve stem; said valve stem being connected with said valve element such that shifting of said valve stem, and with it said spray head, raises said valve element off said valve seat or returns said valve element to said valve seat.

19. The combination of claim 18, further comprising valve element biasing means for acting on said valve element for normally returning said valve element to said valve seat; said valve element biasing means and said spray head biasing means being arranged and selected such that upon application of initial force to said sleeve against the direction of bias of said valve element biasing means, said valve element biasing means is charged while said spray head biasing means is substantially not charged, thereby raising said valve element off said valve seat and permitting exit of material from said container through said sleeve first outlet conduit means; and upon application of greater force to said sleeve against the direction of bias of said spray head biasing means, said spray head biasing means is also charged and said sleeve shifts to said second longitudinal position thereof, permitting exit of material from said container through said sleeve second outlet conduit means.

20. The combination of claim 19, wherein said spray head biasing means and said valve element biasing means exert their respective forces along the same general direction; said spray head biasing means being adapted to exert a greater biasing force than said valve element biasing means along that said same general direction.

21. The combination of claim 20, further comprising a handle connected to said container and in engagement with said sleeve and movable with respect to said container for moving said sleeve with respect to said spool.

22. The combination of claim 20, wherein said first and said second sleeve outlet conduit means terminate in different respective nozzle arrangements, thereby to produce different respective spray patterns of emitted material.

23. The combination of claim 22, wherein another said spool body side is a top side and said top side is opposite to said body bottom side; said body top and bottom sides being different said sides of said body than said body other side; said sleeve being closed above said body top side; said spray head biasing means being connected between said sleeve and said body for biasing said sleeve with respect to said body.

24. The spray head of claim 14, wherein said body and said sleeve meet at an interface; sealing means between said body and said sleeve for sealing said interface between them against flow from said body passage along said interface.

25. The spray head of claim 24, wherein said sealing means comprises a first and a second sealing element supported on and movable with said body; said first and said second sealing elements being longitudinally spaced apart along said body; said sealing elements being placed and spaced such that with said sleeve at said first longitudinal position, said first sealing element is positioned between said first and said second outlet conduit means and said second sealing element is on the side of said first outlet conduit means away from said second outlet conduit means, whereby said sealing elements bracket said first outlet conduit means; and with said sleeve at said second longitudinal position, said first sealing element is on the side of said second outlet conduit means away from said first outlet conduit means and said second sealing element is positioned between said outlet conduit means whereby said sealing elements bracket said second outlet conduit means.

26. The spray head of any of claims 13, 24 or 25, further comprising a groove defined around the periphery of said body and said body passage outlet communicating into said groove; said groove, in turn, selectively communicating with said outlet conduit means through said sleeve, such selection being due to the one of longitudinal shifting of said sleeve with respect to said body between said longitudinal position.

27. The spray head of claim 25, wherein said body has an annular chamber defined around the periphery thereof; said first and said second sealing elements both being in and defining the longitudinal ends of said chamber; said sealing elements being so placed that, as said sleeve shifts with respect to said body, said chamber communicates with said body passage outlet and also selectively communicates with only the respective one of said sleeve outlet conduit means which said sealing element permits communication with.

28. The spray head of claim 1, wherein said first and second outlet conduit means are spaced apart longitudinally along said second portion along a common lingutudinal line along said second portion.

* * * * *